US006966103B2

(12) United States Patent
Gould

(10) Patent No.: US 6,966,103 B2
(45) Date of Patent: Nov. 22, 2005

(54) FASTENING SYSTEM

(76) Inventor: Sheldon D. Gould, 4330 Hillcrest Dr., Hollywood, FL (US) 33021

( * ) Notice: Subject to any disclaimer, the term of this patent is extended or adjusted under 35 U.S.C. 154(b) by 45 days.

(21) Appl. No.: 10/792,430

(22) Filed: Mar. 3, 2004

(65) Prior Publication Data

US 2005/0193527 A1 Sep. 8, 2005

(51) Int. Cl.[7] ..... A44B 21/00
(52) U.S. Cl. ..... 24/351; 24/363; 24/13; 24/561
(58) Field of Search ..... 24/561, 363, 66.13, 24/351, 317, 340, 67 P, 13, 6, 356, 362, 368, 24/51, 60, 595.1, 706.1, 711.1; 132/276

(56) References Cited

U.S. PATENT DOCUMENTS

| | | | | | |
|---|---|---|---|---|---|
| 616,385 | A | * | 12/1898 | Winget | 24/67 R |
| 1,071,688 | A | * | 9/1913 | Bono | 24/351 |
| 1,908,229 | A | * | 5/1933 | Dyer | 24/561 |
| 2,164,940 | A | | 7/1939 | Polak | |
| 2,795,233 | A | | 6/1957 | Zore | |
| 3,082,773 | A | | 3/1963 | Renstrom | |
| 3,860,014 | A | | 1/1975 | Clifton | |
| 3,950,823 | A | * | 4/1976 | Schreter | 24/66.13 |
| 4,011,639 | A | * | 3/1977 | Koleske | 24/561 |
| 4,241,477 | A | * | 12/1980 | Freedom et al. | 24/67 R |
| 5,125,758 | A | * | 6/1992 | DeWan | 24/67 P |
| 5,775,345 | A | * | 7/1998 | Chou | 24/563 |
| 6,000,105 | A | * | 12/1999 | Lee et al. | 24/368 |

* cited by examiner

*Primary Examiner*—Robert J. Sandy
(74) *Attorney, Agent, or Firm*—Melvin K. Silverman

(57) ABSTRACT

1. A fastening system includes a straight pin having a cap end, a shank and a pointed end; a planar border having a base and two integrally formed substantially parallel planar flexible peripheral legs of like length, distal ends of each of the legs having apertures proportioned for slidable receipt of the shank of the straight pin; and an elongate securement leg integrally dependant from the base in a direction of the distal ends of the flexible legs, a distal end of the securement leg including a female surface press-fittably complemental about the pointed end of the straight pin. The pin may be inserted through the apertures when they are aligned with each other, and then held by the female surface to enable securement of a planar peripheral legs to each other.

14 Claims, 4 Drawing Sheets

FASTENING SYSTEM

BE IT KNOWN that I, Sheldon Gould, a resident of the State of Florida and citizen of the United States of America, have invented a certain new and useful improvement in a Fastening System, of which the following is a Specification:

REFERENCE TO RELATED APPLICATION

This Application corresponds to the subject matter of Disclosure Document No. 522,261, filed Nov. 25, 2002.

BACKGROUND OF THE INVENTION

The present invention relates to devices in the nature of hair clips which, subject to adaptations as taught by the within invention, may be employed as a fastening element for the holding of cards and other planar articles.

The prior art in the instant area is reflected in hair clip related patents such as U.S. Pat. No. 2,169,940 (1939) to Polak; No. 2,795,233 (1957) to Zore, entitled Clips; No. 3,082,773 (1963) to Renstrom, et al, entitled Hair Clip; and U.S. Pat. No. 3,860,014 (1975) to Clifton, entitled Hair Clip.

Said patent to Polak teaches a hair clip in which a male element thereof may be secured within a female element to accomplish closure of the clip about a tuft of hair.

Zore teaches a hair clip including a fixed proximal end and a free distal end. Therein, various strategies are taught for the securement of the distal ends of the outermost arms to each other. However, Zore requires the use of a tool to effect a joinder of the ends of the outer arms of the structure to each other.

Renstrom shows the use of a male element within a center arm of a hair clip in which said male element may be snap fittably secured within a complemental aperture within a border-like portion of the hair clip.

Clifton teaches the use of a male-female connection in a hair clip.

However, use of a hair clip device for securement of planar articles, such as business or identification cards, cannot be achieved by any of the above structures, or otherwise, taught in the prior art.

SUMMARY OF THE INVENTION

This invention relates to a fastening system for securement of a card, tag or the like to a portion of fabric clothing of a user. The system more particularly comprises a straight pin having a cap end and a pointed end; a planar border having a base segment and two integrally formed substantially parallel bi-stable, peripheral legs of like length, distal ends of each of said legs having apertures therein, each proportioned for slidable receipt of said shank of said straight pin; and elongate securement means depending from said base in a direction of said distal ends of said legs. A distal end of said securement legs includes a female surface proportioned for press-fittable engagement of said pointed end of said straight pin. On alignment of said apertures with each other, said straight pin may be inserted therethrough and, if desired, a planar article such as an identification card held therein.

It is an object of the present invention to provide a new use of a bi-stable hair clip.

It is another object to provide a fastening system for the securement of planar articles such as an identification card to an article of clothing.

It is a further object to provide an improved hair clip.

Other objects and advantages of the present invention will become apparent from the hereinafter set forth Brief Description of the Drawings, Detailed Description of the Invention and claims appended herewith.

BRIEF DESCRIPTION OF THE DRAWINGS

FIGS. 7–13 are views of a fifth embodiment of the invention, in which FIG. 11 is also an enlarged view of a portion of FIG. 2.

DETAILED DESCRIPTION OF THE INVENTION

Figure 1:
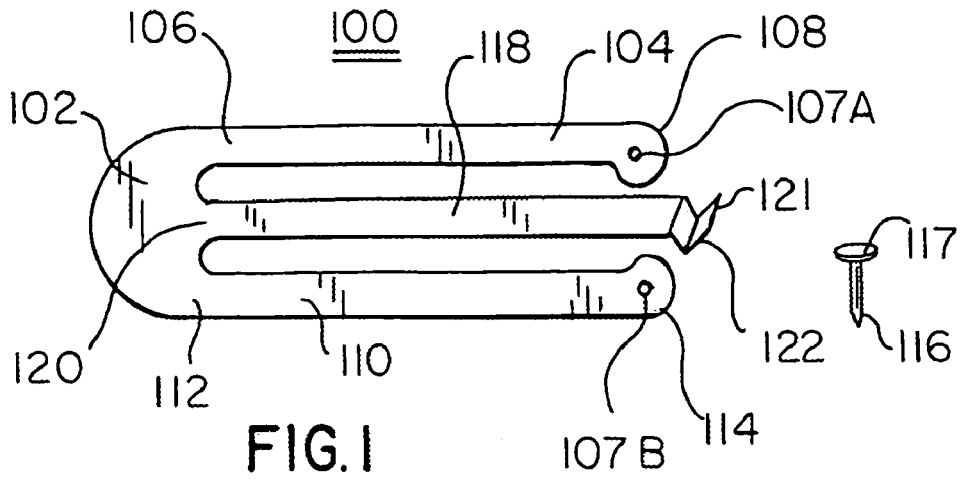
FIG. 1 is a top plan view of a first embodiment of the instant invention.

With reference to the plan view of FIG. 1, a first embodiment 100 of the invention may be seen to include a base 102 from which integrally depends first and second substantially planar, flexible, peripheral legs 104 and 110. First leg 110 includes a proximal end 106 which is integral with said base 102 and a distal end 108 having a preferably rounded periphery and having an aperture 107A therein. Said second leg 110 includes a proximal end 112 and a distal end 114 and an aperture 107B therein.

Medially disposed between legs 104 and 110 is an elongate securement leg 118 having a proximal end 120, which integrally depends from said base 102, and a distal end 121 which includes a female surface 122 proportioned for press-fittable complemental receipt of a pointed end of a straight pin 116, which includes a head 117.

Figure 2:
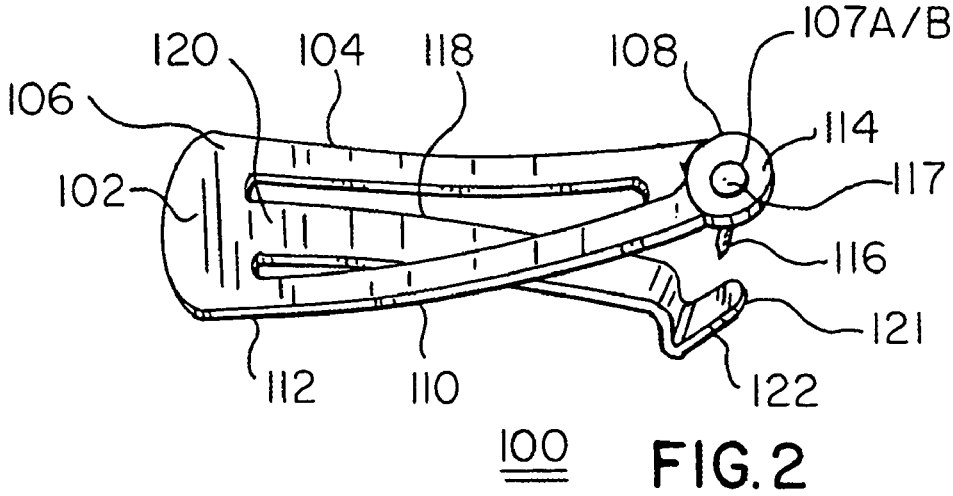
FIG. 2 is a side perspective view thereof.

FIG. 2 is an operational view of the embodiment 100 of the fastening system of FIG. 1. Therein, distal end 114 of second leg 110 is shown in alignment with distal end 108 of leg 104, so that apertures 107A and 107B are in alignment. When in this position, straight pin 116 may be passed therethrough such that head 117 of pin 116 is visible. When in this position, female surface 122 of distal end 121 is aligned beneath the point of straight pin 116, such that engagement therebetween can be manually effected in the manner shown in FIG. 11. Also shown in FIG. 2 is the flexible nature of legs 104 and 110 of the fastening system. The resultant structure of FIG. 2 is one in which a planar article such as a business or identification card may be secured between pin head 117 and female surface 122 when base 122 is appropriately secured to clothing of a user of the system.

Figure 3:
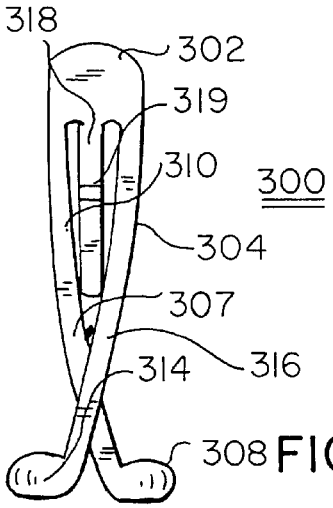
FIG. 3 is an operational view of a second embodiment of the invention.

Shown in FIG. 3 is a second embodiment 300 of the inventive fastening system in which pin 316 depends from a securement member 318 which wedges between legs 304 and 310 when said legs are pulled thereagainst. Further shown in FIG. 3 is base 302 and flexure zone 319 of securement leg 318.

Figure 4:
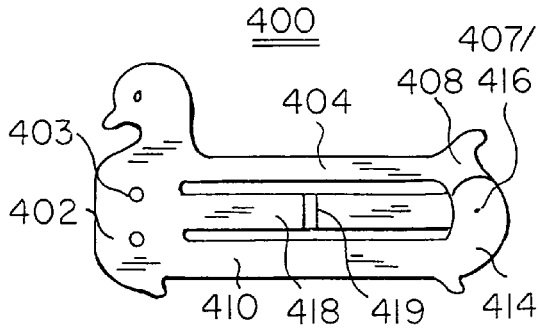
FIG. 4 is a top plan view of a third embodiment thereof.
Figure 7:
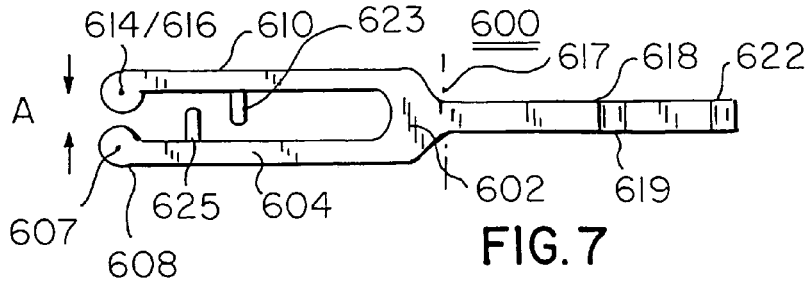
Figure 8:
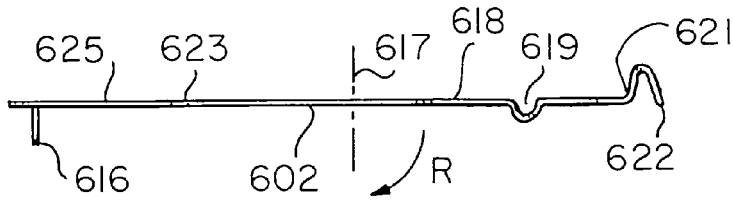

In FIG. 4 is shown an embodiment 400, having a fancible shape of a duck, in which straight pin 416 passes through apertures 407 of distal ends 408 and 414 of legs 404 and 410 respectively of the structure. Said legs depend from base 402 which is provided with apertures 403 which may be used to affix a fastening system of embodiment 400 to an article of clothing.

Figure 5:
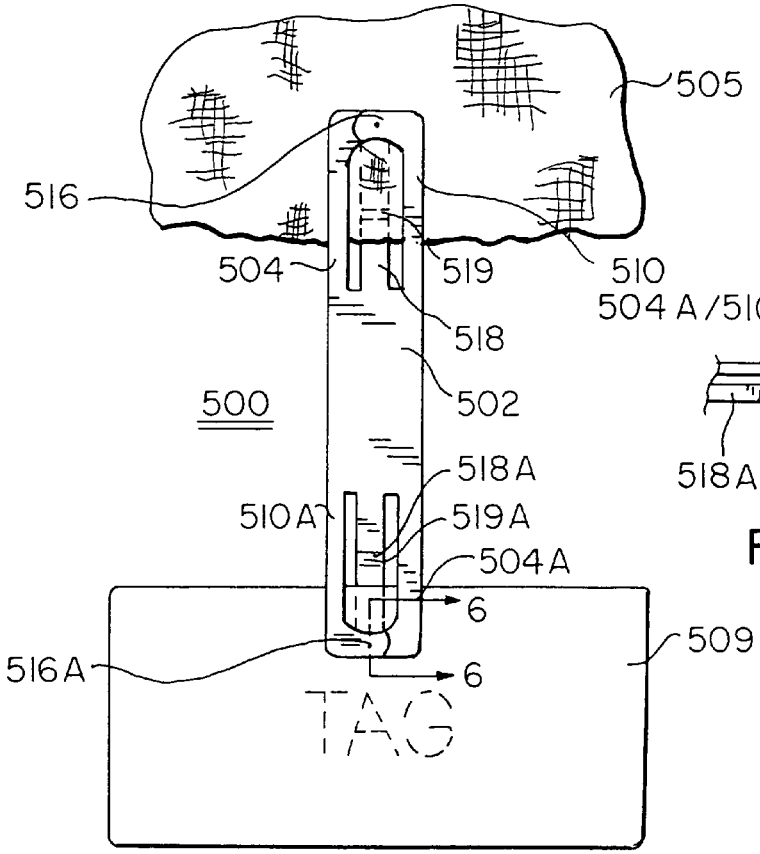
FIG. 5 is an operational view of a fourth embodiment thereof showing the manner in which the inventive fastening means may be used to secure a planar item to an article of clothing.

In the embodiment 500 of FIG. 5 is shown a still further embodiment in which a fastening system 500 includes a central base region 502 from which depends symmetric upper and lower sets of arms, namely, upper arms 504 and 510, and lower arms 504A and 510A. Therein are also shown elongate securement legs 518 and 518A from which depend female engagement surfaces 522 (not shown) and 522A (see FIG. 6). As in the case of the embodiment of FIGS. 3 and 4, there are provided flexure zones 519 and 519A respectively to permit appropriate bending of securement legs 518 and 518A when the system is secured to fabric 505 and/or planar tag 509.

Figure 6:
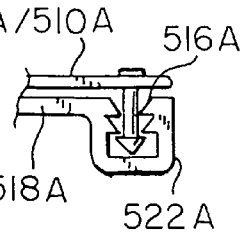
FIG. 6 is a cross-sectional view taken through Lines 6—6 of FIG. 5.

The pin-female surface interface 516A/522A is shown in vertical axial cross-sectional view in FIG. 6.

Figure 9:
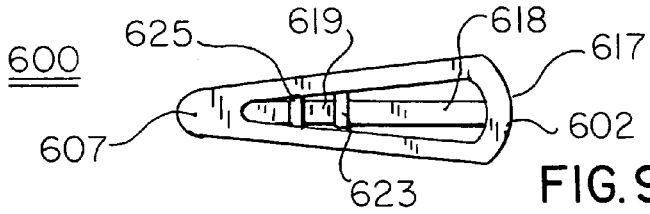
Figure 10:
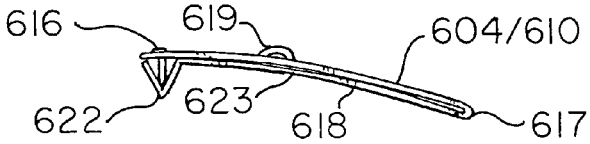

With reference to FIGS. 7 thru 13, there is shown another embodiment 600 of the inventive fastening system which includes an elongate securement leg 618 which integrally depends from a base 602 having line of dependency 617. Also dependent from base 602 is first flexible leg 604 and second flexible leg 610, which include distal ends 608 and 614 respectively. A pin 616 depends from a lower surface of either end 608 or 618 of legs 604 or 610. The distal end not furnished with pin 616 is provided with an aperture 607 (end 608 in the view of FIG. 7). The direction of freedom or flexibility of legs 604 and 610 is indicated by arrows at the left of FIG. 7. Element 619 represents a protrusion within fastening leg 618 which also includes a distal end 621 and complemental female surface 622 therein. The lateral geometry of the article of FIG. 7 may be seen in FIG. 8. In FIG. 10 may be seen the position of pin 616 when distal ends 608 and 614 of arms 604 and 610 respectively are aligned with each other. That is, after such alignment (see arrows A of FIG. 7) has occurred, pin 616 is passed thru aperture 607 and arm 618 folded downward along line of dependency 617 (see arrow R in FIG. 8) to thereby produce the resultant structure which is shown in FIGS. 9 and 10. Therein protrusion 619 of leg 618 snap-fits between elements 623 and 625 which depend from legs 610 and 604 respectively of the system 600. The resultant geometry thereof may be more fully appreciated with reference to the side view of FIG. 10 which shows protrusion between elements 623 and 625 the engagement of pin 616 by female surface 622. As such, the original left and right sides of fastening system 600 (see FIGS. 7 and 8) are engaged to each other by two distinct fastening means, namely, protrusion 619 and pin 616.

Figure 11:
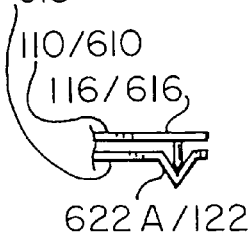
Figure 12:
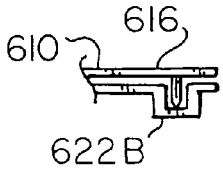
Figure 13:
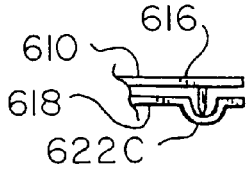

Cross-sectional views of various embodiments of female surface 622 are shown in FIGS. 11, 12 and 13. Therefore, it may be appreciated that female surface 622 may take the form of an angular surface 622A as is shown in FIG. 11, a complemental square surface 622B as is shown in FIG. 12, or a complemental rounded surface 622C as is shown in FIG. 13.

It is noted that a similar strategy may be used in embodiment 100, described above. That is, aperture 107B (see FIG. 1) may be replaced by pin 116, so that said pin passes thru aperture 107A and is held by female surface 122.

Figure 14:
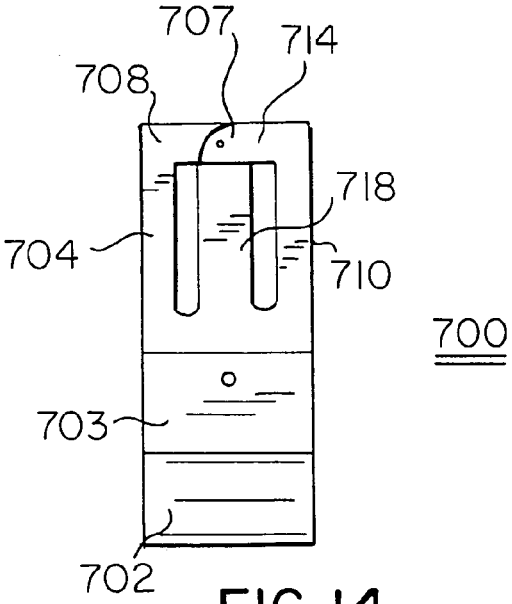
FIGS. 14–15 are views of a sixth embodiment thereof.
Figure 15:
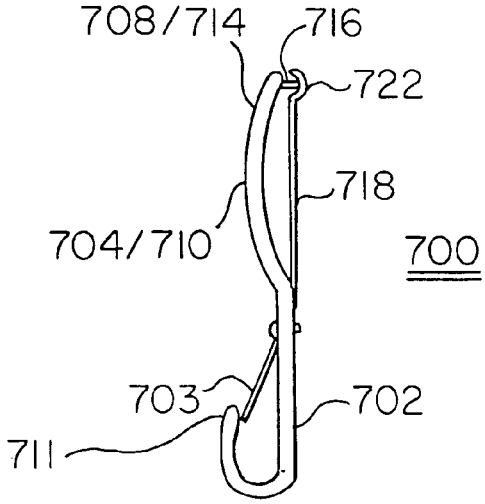

Shown in FIGS. 14 and 15 is a yet further embodiment 700 of the inventive fastening system. The upper part thereof is similar to that of the embodiments of FIGS. 1–2. However, the lower portion thereof includes C-snap surface 702 and resilient element 703. In this arrangement, one end, for example, a combination of elements 708 and 714 through which pin 716 has been passed may be used to secure the system 700 to an article of clothing while resilient element 703 is used to selectably hold a card or tag having a hole therein of a size sufficient to fit over element 711 of surface 702. Conversely, the lower surface of the embodiment 700 of FIGS. 14 and 15 may be used for securement to fabric an article of clothing while the opposite end is used to hold an identification tag of the like.

It is to be appreciated that certain of the structures taught in U.S. Pat. No. 2,795,233 to Zore may be incorporated into the embodiments set above set forth.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

I claim:

1. A fastening system, comprising:

(a) a straight pin having a cap end, a shank and a pointed end;

(b) a planar border having a base and two integrally formed substantially parallel planar flexible peripheral legs of like length, distal ends of each of said legs having apertures therein, each aperture proportioned for slidable receipt of said shank of said straight pin; and (c) an elongate securement leg integrally dependant from said base in a direction of said distal ends of said flexible legs, a distal end of said securement leg including a female surface press-fittably complemental about said pointed end of said straight pin, whereby said pin may be inserted through said apertures when they are aligned with each other, and then held by said female surface to enable securement of said planar peripheral legs to each other.

2. The fastening means as recited in claim 1, in which said base of said border comprises:

means for securement to a fabric of an article of clothing.

3. The system as recited in claim 2, in which said securement arm includes a zone of inducement of flexure.

4. The system as recited in claim 2, in which said securement arm includes a zone of inducement of flexure.

5. The system as recited in claim 1, in which said base further comprises:

(d) clip means having a normally closed selectable open function, said means integrally dependent from said base in a direction opposite said peripheral arms.

6. The fastening system as recited in claim 1, further comprising:

symmetric pairs of said peripheral legs and securement leg, each pair extending in an opposite direction form said base of said border.

7. A fastening system comprising:

(a) a straight pin having a cap end, a shank and a pointed end;

(b) a planar border having a base and two integrally dependent substantially planar, peripheral flexible legs of like length, distal ends of each of said legs having apertures therein, each proportioned for slidable receipt of said shank of said straight pin; and (c) an elongate securement leg integrally dependent from said base in a direction opposite of said distal ends of said first and second legs, a distal end of said securement leg including a female surface press-fittably complemental to said pointed end of said straight pin when said securement leg is rotated and bent toward said base segment in a direction of said pointed end of said pin and pressed thereagainst, after said apertures of said distal ends are aligned.

8. The system as recited in claim 7, in which:

(d) said securement leg includes a medially disposed protrusion in a direction transverse to a plane of said border; and (e) a pair of receiving elements, one dependant from each of said peripheral legs in a plane of said border, a spacing between said elements proportioned for press-fittable receipt of said protrusion when said leg is rotated to said distal ends of said peripheral legs.

9. A fastening system, comprising:

(a) a planar border having a base and two integrally formed substantially parallel planar flexible peripheral legs of like length, a distal end of one leg including a straight pin having a pointed end projecting transversely from a plane of said base of said border and a distal end of another leg having an aperture therein proportioned for slidable receipt of said shank of said straight pin; and (b) an elongate securement leg integrally dependant from said base in a direction of said distal ends of said flexible legs, a distal end of said securement leg including a female surface press-fittably complemental about said pointed end of said straight pin, whereby said pin may be inserted through said aperture aligned therewith, and then held by said female surface to enable securement of said planar peripheral legs to each other.

10. The fastening means as recited in claim 9, in which said base of said border comprises:

means for securement to a fabric of an article of clothing.

11. The fastening system as recited in claim 9, further comprising:

symmetric pairs of said peripheral legs and securement leg, each pair extending in an opposite direction form said base of said border.

12. The system as recited in claim 9, in which said base further comprises:

(c) clip means having a normally closed selectable open function, said means integrally dependent from said base in a direction opposite said peripheral arms.

13. A fastening system comprising:

(a) a planar border having a base and two integrally dependent substantially planar, peripheral flexible legs of like length, a distal end of one leg including a straight pin having pointed end projecting transversely from a plane of said base of said border and a distal end of another leg having an aperture therein proportioned for slidable receipt of said straight pin; and (b) an elongate securement leg integrally dependant from said base in a direction opposite of said distal ends of said first and second legs, a distal end of said securement leg including a female surface press-fittably complemental to said pointed end of said straight pin when said securement leg is rotated and bent toward said base segment in a direction of said peripheral legs pin and pressed therebetween, in which said pin is then passed thru said aperture and against said female surface.

14. The system as recited in claim 13, in which:

(c) said securement leg includes a medially disposed protrusion in a direction transverse to a plane of said border; and (d) a pair of receiving elements, one dependant from each of said peripheral legs in a plane of said border, a spacing between said elements proportioned for press-fittable receipt of said protrusion when said leg is rotated to said distal ends of said peripheral legs.

* * * * *